US005984668A

United States Patent [19]

Hansen et al.

[11] Patent Number: 5,984,668

[45] Date of Patent: Nov. 16, 1999

[54] SPARKING DEVICE FOR PROMOTING AVOIDANCE OF SHORT-CIRCUITING

[75] Inventors: David L. Hansen, Averill Park; Donald V. Mazzarello, Albany, both of N.Y.

[73] Assignee: Landfill Technologies, Inc., West Sand Lake, N.Y.

[21] Appl. No.: 09/134,391

[22] Filed: Aug. 14, 1998

[51] Int. Cl.[6] ..... H01T 13/20

[52] U.S. Cl. ..... 431/202; 431/264; 313/139

[58] Field of Search ..... 431/202, 264; 313/139, 141

[56] References Cited

U.S. PATENT DOCUMENTS

| | | | |
|---|---|---|---|
| 980,723 | 1/1911 | Wilson . | |
| 1,225,467 | 5/1917 | Miller . | |
| 1,270,437 | 6/1918 | Reppin | 313/139 |
| 1,280,113 | 9/1918 | Johnston | 313/139 |
| 1,360,956 | 11/1920 | Hughes . | |
| 1,498,984 | 6/1924 | Trampe . | |
| 2,073,865 | 3/1937 | Bushey | 123/169 |
| 2,489,410 | 11/1949 | Hahn | 123/169 |
| 2,760,099 | 8/1956 | Suter | 313/138 |
| 3,043,980 | 7/1962 | Zalesar | 313/139 |
| 3,691,419 | 9/1972 | Van Uum et al. | 313/138 |
| 3,706,897 | 12/1972 | Shepardson | 313/141 |
| 3,958,144 | 5/1976 | Franks | 313/138 |
| 4,354,136 | 10/1982 | Hamai et al. | 313/139 |
| 4,826,427 | 5/1989 | Hyde | 431/202 |
| 4,876,466 | 10/1989 | Matsumura et al. | 313/131 R |
| 4,976,608 | 12/1990 | Hyde | 431/202 |
| 5,051,651 | 9/1991 | Kashiwara et al. | 313/139 |
| 5,697,334 | 12/1997 | Below | 123/169 R |

*Primary Examiner*—Carroll Dority
*Attorney, Agent, or Firm*—Heslin & Rothenberg, P.C.

[57] ABSTRACT

A sparking device, in one aspect, includes first and second electrodes for coupling with corresponding first and second electric potentials. The first electrode includes an elongate member having proximal and distal parts. The second electrode includes a body receiving the proximal part. A first insulation portion electrically insulates the proximal part of the elongate member from the body. The first electrode includes an end member connected with the distal part of the elongate member. The end member includes a first section with a plurality of first electrical contacts offset from a longitudinal axis of the device. The body includes a second section with a plurality of second electrical contacts offset from the longitudinal axis. A plurality of sets of the first and second electrical contacts provide a plurality of gaps for sparking between the first and second electrodes, wherein a difference provided between the first and second electric potentials serves to cause sparking across at least one of the gaps. A second insulation portion is disposed between the longitudinal axis and at least one of the gaps to form a drainage path section, wherein the drainage path section serves to promote avoidance of short-circuiting between the body and the distal part of the elongate member and/or the end member during exposure of the device to precipitation.

20 Claims, 5 Drawing Sheets

SPARKING DEVICE FOR PROMOTING AVOIDANCE OF SHORT-CIRCUITING

TECHNICAL FIELD

This invention relates, generally, to sparking devices and, more particularly, to sparking devices for outdoor use.

BACKGROUND ART

Outdoor waste gas, such as landfill gas, can present problems such as foul odor and environmental pollution. Landfill gas is organic waste generated as a landfill decomposes. Typically, this foul-smelling gas consists of fifty-five percent methane, forty-four percent carbon dioxide, and one percent various other constituents, ranging from hydrogen sulfide to complex hydrocarbons. Undesirably, landfill gas may cause severe odor problems when released directly into the atmosphere. Further, methane has been characterized as a "greenhouse" gas, which is believed to significantly contribute to global warming.

Once landfills have reached full capacity, they are generally capped with, among other things, a layer of topsoil to support vegetation and help prevent erosion. A gas vent, gas well, or other gas collection system is typically provided in order to enable the landfill gas generated by the decomposition process to conveniently pass through the cap for release (e.g., in a passive arrangement).

Because landfill gas burns relatively cleanly, the gas emerging from such a vent, etc., may be burned in an effort to eliminate the noxious odor and harmful greenhouse effects. One possibility is to provide a flare to burn the gas as it emerges from the vent. However, disadvantages may result; for instance, it may be difficult to ensure that a flame burns continuously once the flare has been ignited. Several factors may contribute to this difficulty, including variations in the flow rate of the gas as a result of environmental conditions such as temperature and ground water levels. Furthermore, gas flows are commonly subject to variability due to barometric pressure and gas quality changes. Variations in percentage composition of the constituents (e.g., methane and carbon dioxide) of the landfill gas may also alter the gas/air mixture from an optimal ratio suited for maintaining or preserving a continuous flame. Moreover, adverse weather conditions such as wind and/or precipitation (e.g., snow, ice, sleet, hail and/or rain) may tend to extinguish the flame.

Preferably, a flare would be situated near the landfill, to minimize lengths of gas pipes needed. Usually, the flare would be disposed in a remote location, where it would be difficult to monitor the presence of flame, and inconvenient to manually reignite the flare in the event the flame is extinguished. During any time in which the flame is out, gas would disadvantageously be released into the atmosphere, thereby presenting the problem of potentially lengthy periods in which odor and greenhouse effects of the landfill would not be treated.

Various devices may be tried in attempts to address such problems. For instance, vent flares may be provided with electronic ignitors or propane pilot lights. Generally, electronic ignitors include sophisticated technology to monitor the presence of a flame. For example, optical or heat sensors may be employed which activate electronic circuitry upon detecting absence of a flame. A shortcoming of such sophisticated equipment is the relatively large expense in terms of up-front capital expenditure and routine maintenance.

Another approach may employ propane pilot light systems to help ensure that the landfill gas flame burns continuously, by providing a continuously burning pilot light. This type of system has the advantage of being relatively unsophisticated and thus, relatively inexpensive to purchase and simple to maintain. However, a drawback of this approach is that the system requires a separate supply of fuel (i.e., propane) which must be replaced periodically. In addition, the pilot light itself may be extinguished by, for example, wind and/or precipitation, undesirably requiring manual re-lighting.

As an improvement over such previous attempts, an exemplary configuration for a landfill gas vent flare is disclosed in U.S. application Ser. No. 08/559,795 by Hansen (entitled "Self Ignited Landfill Gas Vent Flare and Flarehead," filed Nov. 15, 1995, and assigned to Hansen Family Limited Partnership), which is hereby incorporated herein by reference in its entirety. In one aspect, such a landfill gas vent flare comprises a flarehead and at least one spark initiator. The flarehead is adapted for communication with a landfill gas vent, wherein landfill gas is permitted to flow in a downstream direction from the landfill gas vent to the flarehead. The at least one spark initiator is disposed on the flarehead, and is adapted to generate a continuous series of sparks in the flarehead, wherein the landfill gas flowing in the flarehead is ignited and continuously burned.

However, it remains desirable to provide refinements to the sparking in such a flarehead, for example, through special characteristics which enhance re-ignition over a variety of operating conditions. For instance, should a conventional spark plug be employed, water or ice may short-circuit the plug, or cold weather may shatter the insulation of the plug.

Thus, a need exists for a configuration which advantageously prevents or lessens short-circuiting of a sparking device, such as when snow, ice, sleet, hail and/or rain wets the, for example, hot and/or ground electrodes. A further need exists for formation or shaping of, for instance, the hot and/or ground electrodes, and/or formation or positioning of insulation therebetween, to enhance robustness, dependability, reliability, stability, resiliency and/or durability of such a sparking device. Another need exists for such a sparking device which is economical and/or suited for application(s) such as outdoor waste gas vent flares (e.g., passive landfill gas vent flares).

SUMMARY OF THE INVENTION

Pursuant to the present invention, shortcomings of the existing art are overcome and additional advantages are provided through the provision of a sparking device for promoting avoidance of short-circuiting.

In one aspect of the invention, a sparking device includes first and second electrodes. The first electrode is adapted to be coupled with a first electric potential, and includes an elongate member having proximal and distal parts. The second electrode is adapted to be coupled with a second electric potential, and includes a body receiving the proximal part of the elongate member. A first insulation portion is disposed between the proximal part of the elongate member and the body to electrically insulate the proximal part of the elongate member from the body. The insulation material includes first and second insulation portions. The first electrode includes an end member connected with the distal part of the elongate member. The end member includes a first section with a plurality of first electrical contacts offset from a longitudinal axis of the device. The body includes a second section with a plurality of second electrical contacts offset from the longitudinal axis. A plurality of sets of the first and second electrical contacts provide a plurality of gaps for sparking between the first and second electrodes, wherein a difference provided between the first and second electric potentials serves to cause sparking across at least one of the gaps. The second insulation portion is disposed between the longitudinal axis and at least one of the gaps to form a drainage path section, wherein the drainage path section serves to promote avoidance of short-circuiting between the body and the distal part of the elongate member and/or the end member during exposure of the device to precipitation.

In another aspect of the invention, first and second contacts of the first electrical contacts of the end member can be offset from the longitudinal axis of the device by a distance. Also, third and fourth contacts of the second electrical contacts of the body can be offset from the longitudinal axis by the distance. The first and third contacts can comprise a first set of the plurality of sets of the first and second electrical contacts providing the plurality of gaps for sparking between the first and second electrodes, and the second and fourth contacts can comprise a second set of the plurality of sets.

A portion of the end member can be formed to draw a precipitation portion away from the body. The end member can include a recessed surface facing the body and/or a protruding surface facing away from the body. The second insulation portion can abut the recessed surface. The recessed surface can cover an end of the second insulation portion. The first electrical contacts of the end member can comprise a peripheral section of the end member.

A portion of the body can be formed to draw a precipitation portion away from the end member. The body can include a recessed surface facing the end member. The body can include an inlet open toward the end member. The second electrical contacts of the body can comprise a peripheral section of the body.

The elongate member and the end member can be formed integrally. The first and second insulation portions can be formed integrally.

The body can include a passage therethrough, and the passage can receive the proximal part of the elongate member and/or the first insulation portion. An exposed connection to the proximal part of the elongate member can be located without the passage, and a portion of the body can be formed to draw a precipitation portion away from the exposed connection. A portion of the proximal part of the elongate member can be located without the passage. A part of the first insulation portion can be located without the passage.

In a combination with a flarehead, the plurality of sets of the first and second electrical contacts providing the plurality of gaps for sparking between the first and second electrodes can be disposed within an open-faced interior of the flarehead.

In yet another aspect of the present invention, a sparking device includes first and second electrodes. The first electrode is adapted to be coupled with a first electric potential, and includes an elongate member having proximal and distal parts. The second electrode is adapted to be coupled with a second electric potential, and includes a sleeve having a passage therethrough for receiving the proximal part of the elongate member. The first electrode includes an end member connected with the distal part of the elongate member. The end member includes a first section with a plurality of first electrical contacts offset from a longitudinal axis of the device. The sleeve includes a second section with a plurality of second electrical contacts offset from the longitudinal axis. A plurality of sets of the first and second electrical contacts provide a plurality of gaps for sparking between the first and second electrodes, wherein a difference provided between the first and second electric potentials serves to cause sparking across at least one of the gaps. Insulation material includes first and second insulation portions. The first insulation portion is disposed between the proximal part of the elongate member and the body to electrically insulate the proximal part of the elongate member from the body. The second insulation portion is disposed between the distal part of the elongate member and at least one of the gaps to form a drainage path section, wherein the drainage path section serves to promote avoidance of short-circuiting between the body and the distal part of the elongate member and/or the end member during exposure of the device to precipitation.

The invention further contemplates a method for promoting avoidance of short-circuiting of a sparking device. First and second electrodes are selected for the device. The first electrode includes an elongate member and an end member. The elongate member has proximal and distal parts. The end member is connected with the distal part of the elongate member. The second electrode includes a body receiving the proximal part of the elongate member. A plurality of first electrical contacts of the end member are offset from a longitudinal axis of the device. A plurality of second electrical contacts of the body are offset from the longitudinal axis. A plurality of sets of the first and second electrical contacts are employed to form a plurality of gaps for sparking between the first and second electrodes, wherein a difference provided between a first electric potential coupled with the first electrode and a second electric potential coupled with the second electrode serves to cause sparking across at least one of the gaps. A first insulation portion is disposed between the proximal part of the elongate member and the body to electrically insulate the proximal part of the elongate member from the body. A second insulation portion is disposed between the longitudinal axis and at least one of the gaps to form a drainage path section, wherein the drainage path section serves to promote avoidance of short-circuiting between the body and the distal part of the elongate member and/or the end member during exposure of the device to precipitation.

Thus, the present invention advantageously provides a sparking device (e.g., for a landfill gas vent flare) that is relatively inexpensive and/or requires little maintenance, yet serves to reliably maintain a continuous flame under a wide range of operating conditions.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be readily understood from the following detailed description of preferred embodiments taken in conjunction with the accompanying drawings in which:

BEST MODE FOR CARRYING OUT THE INVENTION

In accordance with the principles of the present invention, a sparking device is provided in which formation(s) and/or configuration(s) of portion(s) thereof serves to promote avoidance of short-circuiting notwithstanding exposure of the sparking device to precipitation.

An example of a gas vent flare with a sparking device incorporating and using the novel features of the present invention is depicted in the Figures and described in detail herein.

Figure 1:
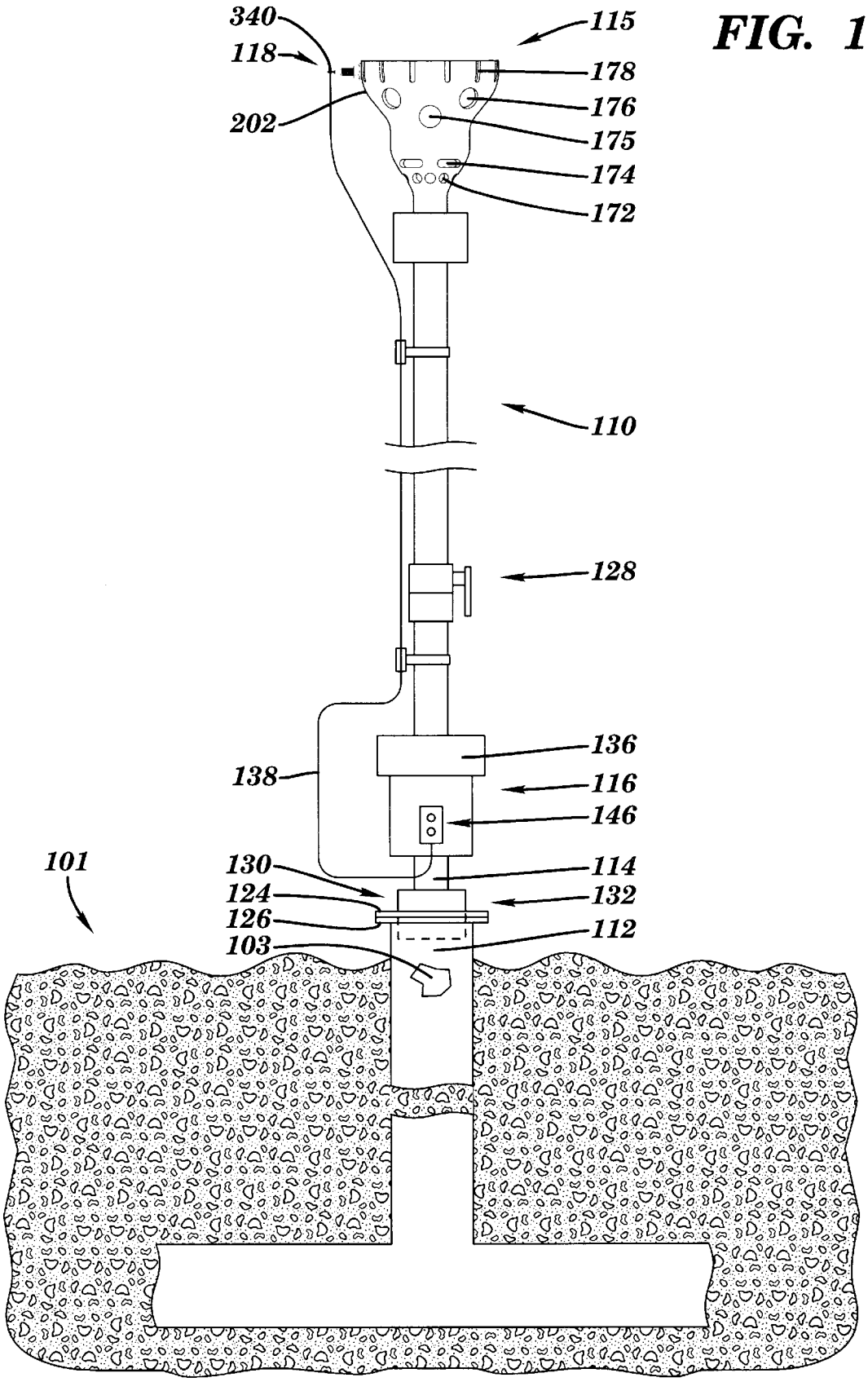
FIG. 1 is a cutaway, partial, elevation, front representation of one example of a gas vent flare incorporating and using the sparking device of the present invention, illustrating the sparking device disposed on a flarehead of the gas vent flare in an exemplary position, and illustrating the gas vent flare disposed in operative engagement with a landfill gas vent for a landfill.

Referring to FIG. 1, in this exemplary embodiment gas vent flare 110 serves to control odors and abate greenhouse gas emission(s) from landfill 101 by burning landfill gas that emerges from gas vent 103 in tubing or piping 112. For instance, the gas vent may be in fluid communication with a gas well (not shown) or other gas collection system located at the landfill.

Still referring to FIG. 1, gas vent flare 110 includes gas flow member or conduit 114 connected with (e.g., fastened to) piping 112. So, landfill gas may be allowed to flow from vent 103, through the conduit, and into flarehead 115 where the gas may be ignited and burned by sparking device 118 (FIG. 2), as described herein.

Further referring to FIG. 1, gas vent flare 110 may, in one example, include components such as ignitor 116 (e.g., a solar-powered ignitor), valve 128 and flame arrestor 132. A description of operation of these components with piping 112 and flarehead 115 is presented herein, with further details provided in the above-incorporated Application Ser. No. 08/559,795 pilot light systems. Moreover, this advantage may be provided without fine-tuning the flare to compensate for variations in gas flow rate or percentages in constituent gases, since even in the event of conditions which would under normal conditions be insufficient to provide a self-sustaining flame, the continuous sparking of the present invention may reignite the gas with sufficient frequency as to effectively create a continuous flame.

Ignitor 116 may include solar collector 136 and (e.g., on/off) switch(es) 146 for reliable ignition and continuous burning under a variety of conditions. The solar collector may serve to charge a battery (not shown) coupled with a transformer (not shown) to "step up" the voltage of the battery output, as will be understood by those skilled in the art. A timekeeping device may serve to (e.g., at predetermined intervals) send high voltage impulses to hot lead 138 coupled with sparking device 118. In one embodiment, the battery of the ignitor can supply enough energy to operate the sparking device continuously for approximately two weeks without recharge from the solar collector, thus enabling operation notwithstanding relatively long periods of overcast weather.

Figure 2:
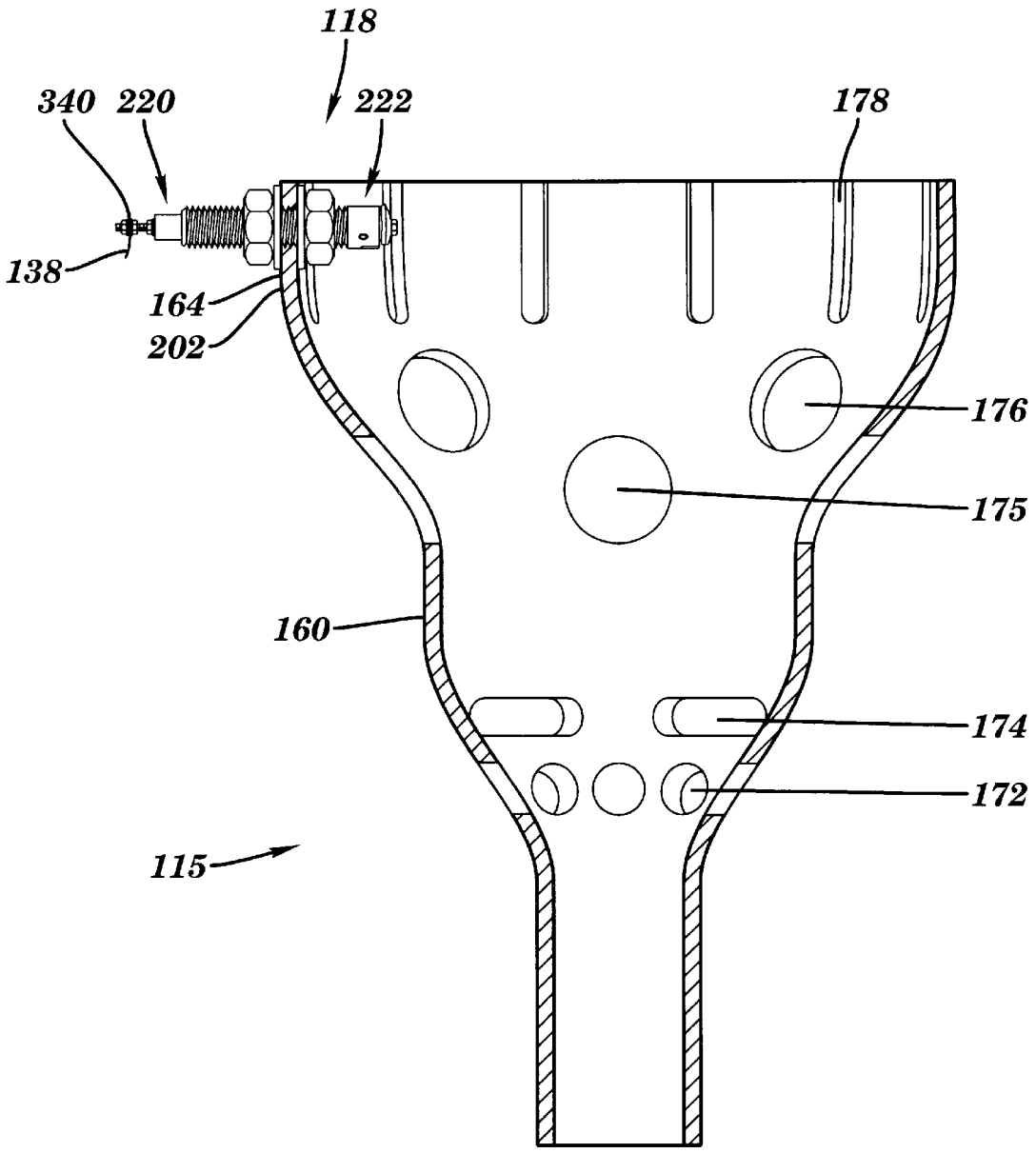
FIG. 2 is a magnified, sectional, elevation, front view of the flarehead of FIG. 1, illustrating the sparking device extended an exemplary distance into or within the flarehead.

Furthermore, still referring to FIGS. 1–2, flarehead 115 may be provided with a geometry and/or series of inlet(s) (e.g., apertures 172, slots 174, orifices 175, 176, and/or slits 178) to facilitate mixing of the landfill gas with air, such as for promoting combustion and helping ensure that the flame will be sustained even in adverse weather conditions. In one example, the flarehead may be formed with a metallic (e.g., electrically conductive) material, such as black iron, and may include walls which diverge in the downstream or gas flow direction, such as to provide a modified frustoconical or bell shape.

In one example, again referring to FIG. 1, conduit 114 may comprise a (e.g., metallic) pipe connected (e.g., in an air tight fashion) with an (e.g., exposed) end of piping 112, to permit the landfill gas to flow therethrough along a passage between landfill 101 and flarehead 115. In one embodiment, as will be understood by those skilled in the art, the conduit may be fastened to the piping by threadably disposing a bushing (not shown) on one end of the pipe, threadably or otherwise fastening the bushing to conduit flange 124, and mating the conduit flange with pipe flange 126 disposed on the end of the piping. For instance, the flanges 124 and 126 may be maintained in mating engagement using threaded fasteners (not shown). In one example, the conduit and the bushing may be formed with a conductive material such as black iron.

Still referring to FIG. 1, valve 128 (e.g., a stainless steel ball valve) may be disposed at a location along the length of conduit 114, for example, to permit a user to control the rate of flow of landfill gas therethrough, such as for varying the size of flame or shutting off the gas flow entirely. Also, flame arrestor 132 may be disposed at a position along the length of the conduit, for example, upstream of the valve and near entrance end 130 of the conduit, leading to flarehead 115. For safety purposes, as will be understood by those skilled in the art, the flame arrestor serves to prevent ignited gases from "backflashing" upstream of the flame arrestor.

As will be appreciated by those skilled in the art, in one example, a ground cable (not shown) may be employed to couple conduit 114 with a steel ground stake (not shown), for nominally grounding flarehead 115. The grounding provides safety benefits and enables a proper operation of sparking device 118, as described herein.

When gas vent flare 110 has been installed and sparking device 118 has been mounted, valve 128 may be opened to permit landfill gas to flow through conduit 114, and switch 146 may be operated to ignite the gas in flarehead 115. A user may operate the valve to optimize the size of the flame, for example, relative to a position or location of the sparking device.

An exemplary configuration for sparking device 118 disposed on flarehead 115 is now described. For illustrative purposes, the sparking device is depicted in FIGS. 1–4 as extending through an opening in wall 202 of the flarehead.

Referring to FIG. 2, sparking device 118 may be considered to include tail portion 220 and head portion 222. In one example, the tail portion(s) may be considered to be generally disposed at and/or outside and/or extending outwardly from wall 202 and/or without flarehead 115. Further, the head portion(s) may be considered to be generally disposed at and/or inside and/or extending inwardly from the wall 202 and/or within the flarehead. In one example, landfill gas flowing into the flarehead may be ignited and burned by sparking at the head portion of the sparking device, as described herein.

Figure 3:
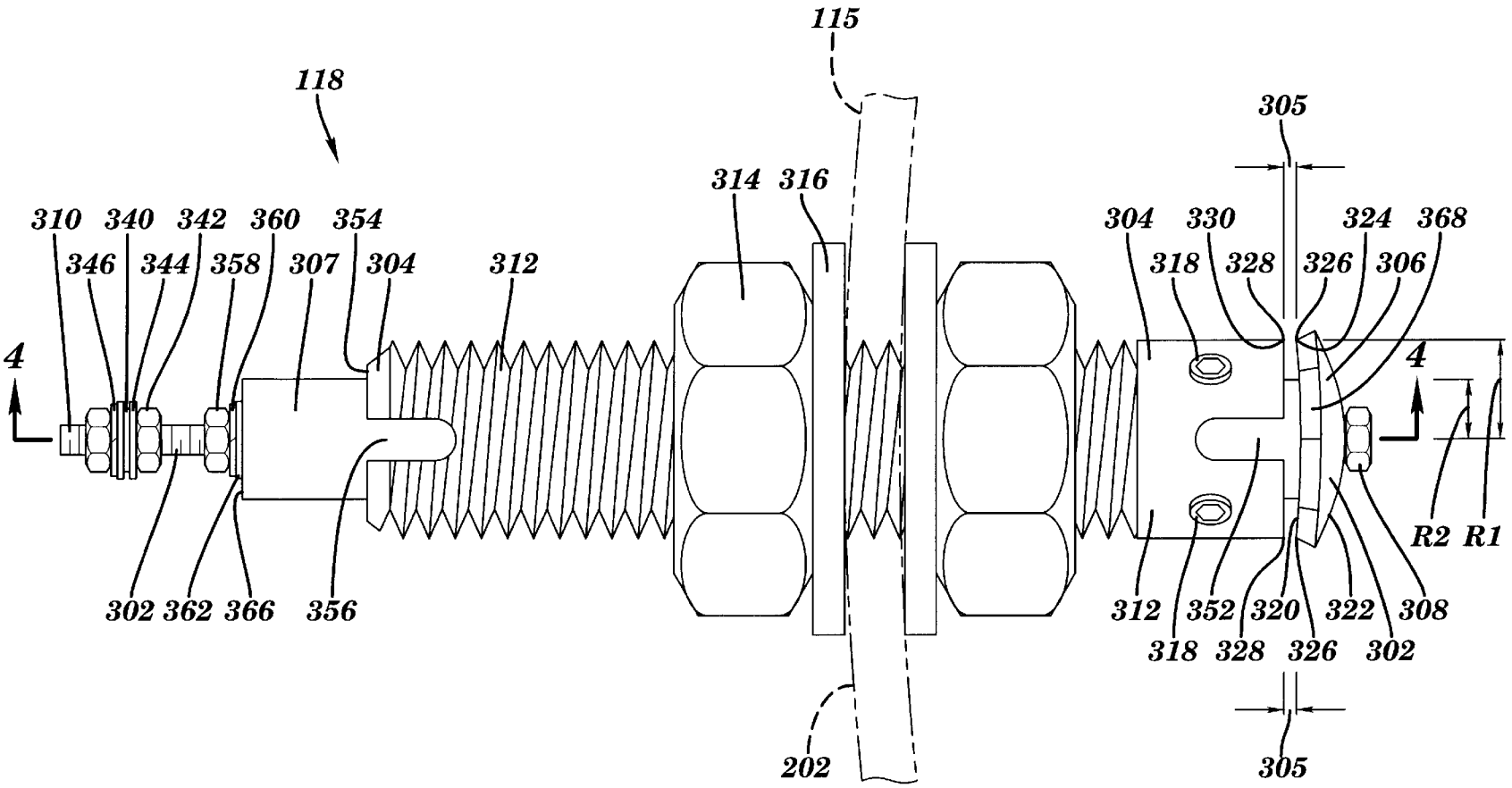
FIG. 3 is a magnified, bottom, plan view of the sparking device of FIG. 2, illustrating a wall of the flarehead in phantom.
Figure 4:
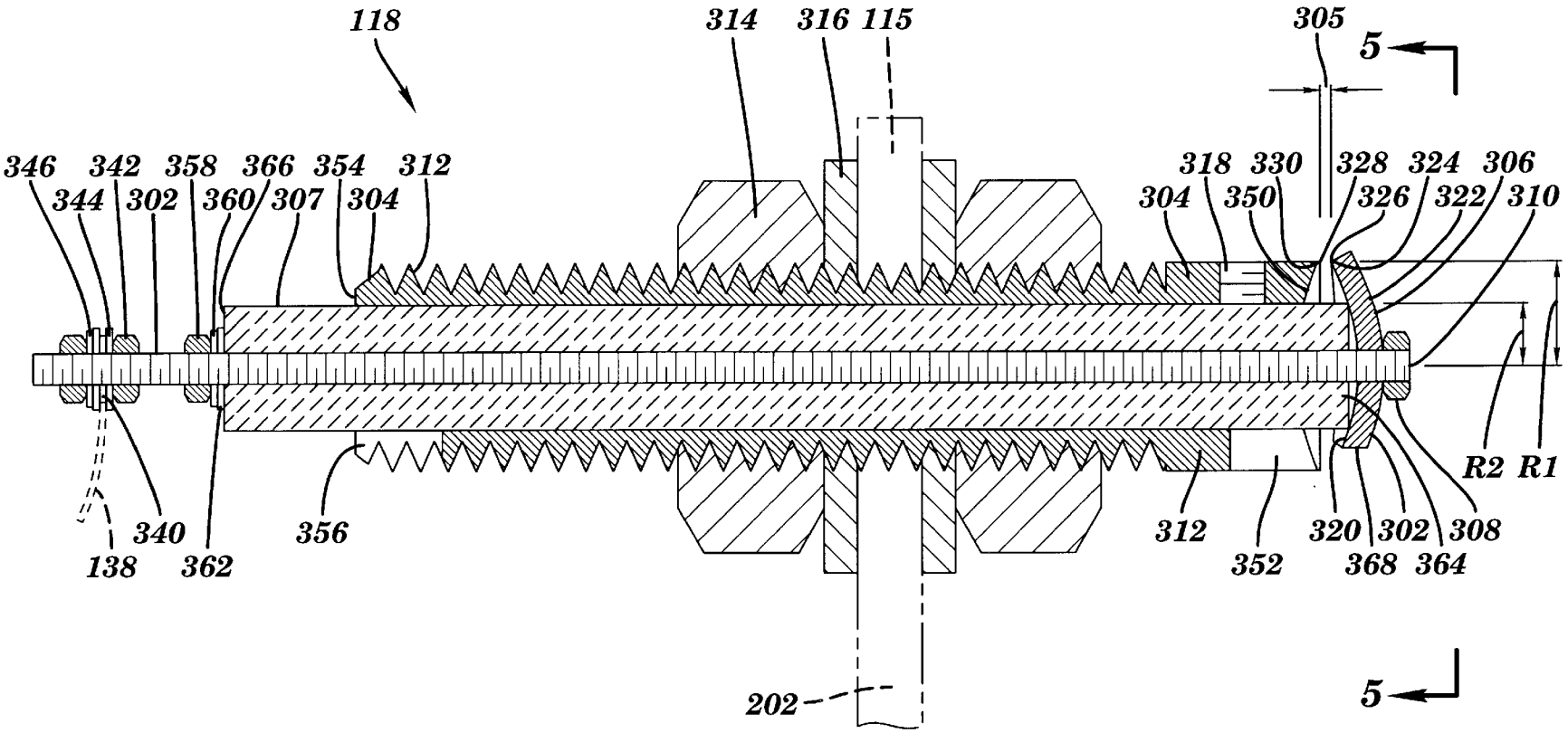
FIG. 4 is a sectional representation directed substantially along line 4—4 of FIG. 3.

Now referring to FIGS. 3–4 for one example in which sparking device 118 includes hot electrode 302 and ground electrode 304. The hot electrode may be coupled with hot lead 138 and igniter 116 (FIGS. 1, 2 and 4), and the ground electrode may be coupled with a ground or arbitrary "zero" electric potential (e.g., through flarehead 115, conduit 114, and a ground cable and/or stake), to cause sparking between the hot and ground electrodes at gap(s) 305, as will be appreciated by those skilled in the art. In one aspect, (e.g., ceramic) insulator 307 may be disposed between the hot and ground electrodes to avoid short-circuiting therebetween away or separate from the gaps, as described herein.

In one example, component(s) of electrodes 302 and 304 are preferably formed with material(s) such as stainless steel, and are most preferably formed with material(s) such as Schedule 80, and/or grade 304 and/or 316 stainless steel. The insulator may be formed, for instance, with a ceramic ignition insulator as manufactured by Crown Engineering (Farmingdale, N.J.) and sold under the trade designation Part #12040-25.

Again referring to FIGS. 3–4, in one example, hot electrode 302 may be formed with cap 306 mounted and/or fastened (e.g., with nut 308) on (e.g., threaded) rod 310. Furthermore, ground electrode 304 may be formed with (e.g., tubular) body 312, which may be mounted on and/or coupled with flarehead 115, such as with nut(s) 314 and washer(s) 316. Setscrew(s) 318 may fasten the body and insulator 307. For example, three instances of the setscrews may be tapped or inserted through respective (e.g., threaded) holes (e.g., symmetrically) located around (e.g., a perimeter of) the body.

Figure 5:
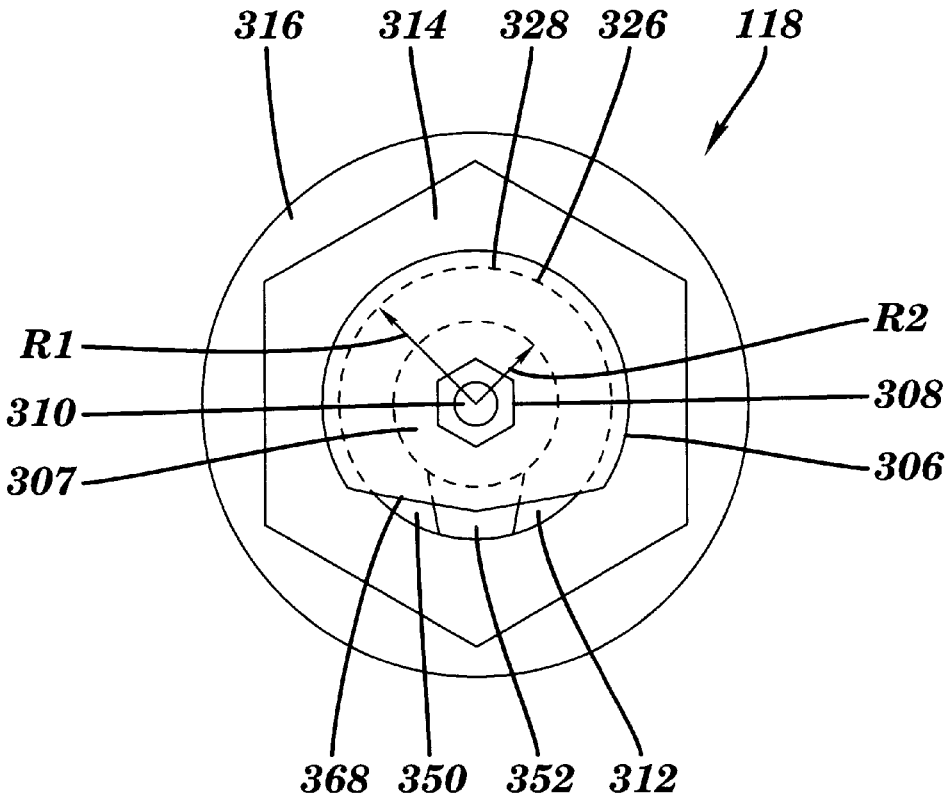
FIG. 5 is a cutaway, end view directed substantially along line 5—5 of FIG. 4.

Now referring to FIGS. 3–5, in one aspect, cap 306 may comprise a disk having concave surface 320 and convex surface 322. The concave surface(s), for instance, may be considered to face proximally toward body 312. In one example, the concave surface may have first (e.g., peripheral) section or rim 324 including a plurality of first contacts 326 disposed approximately at (e.g., transverse) offset R1, such as radius R1 of device 118, and facing a plurality of second contacts 328. Further, the second contacts may be disposed approximately at the offset R1 on second (e.g., peripheral) section or rim 330 of the body 312. So, (e.g., longitudinal) gaps 305 may be formed between multiple sets (e.g., pairs and/or groups) of the first and second contacts, for sparking therebetween and/or thereamong. In another aspect, the first contacts may be considered to face proximally toward the second contacts, and the second contacts may be considered to face distally toward the first contacts.

As will be appreciated by those skilled in the art, concave surface 320, in one embodiment, may comprise a recessed or receding surface. Further, convex surface 322, in one embodiment, may comprise a protruding or bulging surface. Moreover, in one embodiment, gaps 305 may be disposed at various or a plurality of (e.g., transverse) offsets, rather than a single or shared approximate offset R1.

In one embodiment, a multiplicity (e.g., a series, array or continuous stretch) of gaps 305 having appropriate spacing thereacross may contribute to reducing, minimizing and/or eliminating short-circuiting of the gaps, such as when precipitation impacts device 118, or drains thereto, therein, thereon, therethrough and/or therefrom (e.g., as thin liquid film). In one aspect, such multiplicity of gaps may provide a redundancy which promotes sparking across certain gap(s) 305 notwithstanding (e.g., momentary or persistent) problematic condition(s) and/or circumstance(s) at other gap(s) 305. For instance, there may be provided a desired (e.g., two-hundred-and-forty, or any appropriate range of, degree and/or configuration of) spatial availability of gaps 305 for sparking (e.g., electrical arcing) under various conditions, such as wind, snow, ice, sleet, hail, rain and/or gas flow variability owing to factors such as barometric pressure and/or gas quality change(s). Unlike the small number of prong(s) previously available with (e.g., automotive) spark plugs, the present invention, in one example, advantageously provides a multitude of possible electrical paths at the gaps, whereby at least one sparking path always or nearly always exists. In another aspect, feature(s) such as spacing of the gap(s) may allow drainage (e.g., of thin liquid film) therethrough without short-circuiting the gap(s).

Still referring to FIGS. 3–5, insulator 307 may, in one example, comprise an integral, hollow (e.g., ceramic) insulator disposed about (e.g., telescoped over) rod 310. In addition, body 312 may comprise, for instance, a cylindrical (e.g., stainless steel) sleeve disposed about (e.g., telescoped over) the insulator. In one aspect, the insulator may extend from a location (e.g., exterior of flarehead 115) following connection 340 from hot lead 138 to the rod, and the insulator may extend to concave surface 320 of cap 306. For instance, the connection may be employed in conjunction with item(s) such as nut(s) 342, washer(s) 344 and/or lock washer(s) 346. Furthermore, the insulator may serve to hold the cap at a desired distance for formation of the gap(s) 305. The cap, in turn, may serve to substantially evenly distribute compressive stress(es) at distal end 364 (FIG. 4) of the insulator. In one embodiment, assembling of sparking device 118 includes placement or positioning of nut 358, lock washer 360 and washer 362 at proximal end 366 (FIG. 4) of the insulator. In one example, the sparking device may be compressed to a torque of ten foot-pounds.

In another aspect, referring to FIGS. 3–5, body 312 may (e.g., concentrically) receive or support (e.g., a portion of) insulator 307, which may have an approximate (e.g., transverse) dimension R2, such as where the body is for med to have a hollow, cylindrical or tubular shape with passage therethrough of approximate radius R2. In particular, the radius R2 may be selected to be (e.g., a predetermined offset) less than radius R1 corresponding to gaps 305, thereby promoting avoidance of short-circuiting of sparking at the gaps during exposure of device 118 to precipitation, as described herein.

In one example and as can be understood through examination of FIGS. 3–5, insulator 307 may contribute to formation of drainage path(s) or pattern(s) which promote avoidance of short-circuiting of sparking at gap(s) 305 during exposure of device 118 to precipitation. For instance, the insulator may advantageously permit precipitation (e.g., snow, ice, sleet, hail and/or rain) to drain away from gap(s) 305 in a way which lessens, minimizes and/or eliminates occurrence(s) of short-circuiting between hot electrode 302 and ground electrode 304. In one embodiment, a (e.g., transverse or radial) difference provided between radii R1 and R2 allows precipitation to (e.g., quickly) pass the gaps and drain upon the insulator 307, where the insulator may contribute to providing drainage path(s) or pattern(s) for keeping the precipitation from contacting more than one of the electrodes 302 and 304 at any moment or for more than a momentary duration. In one aspect and as further described herein, (e.g., following initial impact of precipitation upon the device 118) such drainage path(s) or pattern(s) may serve to channel or guide precipitation portion(s) in a way which promotes avoidance of short-circuiting between the electrodes 302 and 304.

As will be appreciated by those skilled in the art, advantage(s) or desirable feature(s) similar to those described herein with respect to upper instance(s) of the gap(s) 305, may occur or be provided for medial or lower instance(s) of the gaps 305, in accordance with the principles of the present invention.

A description of exemplary drainage is now presented with reference to FIGS. 3–5. For example, referring to FIG. 4 and considering an upper instance of the gaps 305 between a pair of first and second contacts 326 and 328, the present invention advantageously promotes avoidance of short-circuiting. Due to surface tension of liquid, as will be understood by those skilled in the art, when a precipitation portion is presented at or near an upper instance of the gaps 305, the precipitation portion may closely follow contour(s) or shape(s) of device 118. In one example, a precipitation portion may impact and closely follow surface(s) of body 312. In another example, a precipitation portion may impact and closely follow surface(s) of cap 306.

Flow upon body 312 is now described with reference to FIGS. 3–5. In one example, referring to FIG. 4, rim 324 may form a peripheral portion of distal face 350 of the body. In one enhancement, the distal face 350 may be formed (e.g., machined, ground, cut or beveled) to recede proximally with (e.g., radially) inward progression thereof. For instance, the distal face may slope or curve inwardly away from cap 306. So, when a precipitation portion flows upon the distal face 350, the receding surface may promote avoidance of short-circuiting at an upper instance of the gaps 305 by (e.g., surface tension of liquid) drawing the precipitation portion proximally away from the cap. However, with a certain symmetry in face 350, a precipitation portion drawn away from an upper instance of the gaps may be returned at or near a lower instance of the gaps 305. Thus, in an exemplary enhancement detailed in FIGS. 3–5, a part (e.g., an underside) of the distal face 350 may be formed or shaped (e.g., machined, ground, cut or beveled) to promote avoidance of short-circuiting (e.g., bridging) thereat. For example, notch, groove, slot, channel or inlet 352 may be provided so a precipitation portion may be drawn (e.g., by surface tension of liquid) away from cap 306, and then simply fall away from device 118 (e.g., owing to gravitational force) upon reaching a cessation, termination or discontinuity of the body. The inlet 352 represents an elimination or modification of material upon which precipitation portion(s) might (e.g., otherwise) flow. The precipitation portion(s) may thus be guided proximally to fall from the body further away from the first contacts 326, to promote avoidance of short-circuiting of the gap(s).

With respect to flow upon cap 306, a precipitation portion may flow upon concave surface 320 or convex surface 322. In one aspect, the concave surface promotes avoidance of short-circuiting at an upper instance of the gaps 305 by (e.g., surface tension of liquid) drawing the precipitation portion (e.g., distally) away from body 312. In another aspect, convex surface 322 promotes avoidance of short-circuiting at an upper instance of the gaps 305 by (e.g., surface tension of liquid) drawing a precipitation portion away therefrom. However, with a certain symmetry in any number of the surfaces 320 and/or 322, a precipitation portion drawn away from an upper instance of the gaps may be returned at or near a lower instance of the gaps 305. So, in an exemplary enhancement detailed in FIGS. 3–5, lower portion 368 of the cap may be removed, formed or shaped (e.g., machined, ground, cut or beveled) to promote avoidance of short-circuiting thereat. That is, a precipitation portion may simply fall away from device 118 (e.g., owing to gravitational force) upon reaching a cessation, termination or discontinuity of the cap (e.g., at the lower portion 368. Preferably, such shaping of the lower portion of the cap nevertheless still allows the cap to cover distal end 364 (FIG. 4) of the insulator, thereby maintaining a substantially even distribution of compressive stress(es), as will be appreciated by those skilled in the art.

In a further aspect, insulator 307 may cooperate with distal face 350 and/or concave surface 320 to promote avoidance of short-circuiting between hot and ground electrodes 302 and 304. That is, the insulator may have an (e.g., cylindrical) exterior surface approximately at radius R2, which allows a precipitation portion to pass (e.g., radially and/or at an offset) inward of the gap(s) 305, without interfering with sparking thereacross. Furthermore, a concave, recessed or receding surface of the distal face may serve to draw precipitation portion(s) (e.g., proximally) away from cap 306, while also increasing room for drainage in a medial section, such as between upper and lower instances of the gaps 305. Moreover, by covering rod 310 at location(s) near the distal face 350, the insulator may serve to ensure that precipitation portion(s) drain without creating short-circuits between the distal face and the rod, and/or between the distal face and concave surface 320.

In yet another aspect, insulator 307 may extend (e.g., continuously) a selected distance proximally of (e.g., outward from) proximal face 354 of body 312, to promote avoidance of short-circuiting between rod 310 of hot electrode 302 and the proximal face 354 of ground electrode 304, during exposure of device 118 to precipitation. For instance, the insulator may (e.g., by surface tension of liquid) present a sufficient longitudinal extent, region or expanse that a precipitation portion passing from (e.g., an upper part of) the body is discouraged or prevented from maintaining an electrical path between the proximal face and the rod (e.g., in the presence of gravitational force), as will be appreciated by those skilled in the art. In an exemplary enhancement detailed in FIGS. 3–4, a part (e.g., an underside) of the proximal face 354 may be formed or shaped (e.g., machined, ground, cut or beveled) to promote avoidance of short-circuiting (e.g., bridging) thereat. For example, notch, groove, slot, channel or inlet 356 may be provided so a precipitation portion may be drawn (e.g., by surface tension of liquid) away from proximal end 366 of insulator 307, and then simply fall away from the device 118 (e.g., owing to gravitational force) upon reaching a cessation, termination or discontinuity of the body. The inlet 356 represents an elimination or modification of material upon which precipitation portion(s) might (e.g., otherwise) flow. The precipitation portion(s) may thus be guided distally to fall from the body further away from an (e.g., exposed) electrical connection to a proximal end of the rod (e.g., at nut 358, lock washer 360 and/or washer 362), to promote avoidance of short-circuiting between the hot and ground electrodes.

In a still further aspect, insulator 307 may be formed to withstand thermal shock. In particular, the insulator may endure large thermal shocks from great temperature change during which device 118 may be "red hot" (e.g., above 1200 degrees Fahrenheit) at one moment, and then suddenly approach freezing (e.g., nominally 32 degrees Fahrenheit) a few seconds later, such as during exposure to freezing rain, where the device must continue to operate and reignite (e.g., at temperatures above 1000 degrees Fahrenheit). The insulator may comprise, for instance, integral ceramic insulation.

For illustrative purposes, an exemplary configuration for sparking device 118 is now presented with reference to FIGS. 3–5. Body 312, in one embodiment, may comprise a hollow, cylindrical body having a length in the approximate range of 3.0 to 4.5 in., an interior diameter in the approximate range of 0.5 to 1 in., and an exterior wall thickness in the approximate range of 0.0625 to 0.25 in. Further, the body may have an exterior which is threaded for about 2.5 to 4 in., and not threaded for a final approximately 0.5 to 1 in. near second contacts 328 for gap(s) 305. Insulator 307, in one example, may have a length in the approximate range of 4 to 7 in., an outer diameter in the approximate range of 0.5625 to 0.875 in. and an inner diameter sized to receive rod 310 In a further example, setscrew(s) 318 may be of size 10–24. In one aspect, rod 310 may have an approximate diameter of 0.125 in., and an approximate length of 5.25 in. Cap 306, in another aspect, may be dome-shaped having an outside diameter in the approximate range of 0.75 to 1.5 in., and a center hole sized to receive the rod 310. For instance, the gap(s) 305 may have an approximate spacing or length of 0.045 in. (e.g., between first and second contacts 326 and 328). In one example, inlets 352 and 356 may have lengths in the approximate range of 0.25 to 0.50 in., and approximate medial widths of 0.25 in.

Design choice(s) may allow variation(s) of dimension(s) and/or material(s) for sparking device 118 and/or flarehead 115. For instance, configuration(s) and/or structure(s) may be determined with regard to intended application(s), expected volumetric and/or flow rate(s) of (e.g., landfill) gas, and/or desired size(s) of flame. Furthermore, design choice (s) may permit variation(s) in construction technique(s) for any portion(s) of sparking device 118 and/or flarehead 115. For example, any number of component(s) of electrodes 302 and/or 304 may be formed integrally.

FIG. 2 depicts sparking device 118 as disposed along (e.g., cylindrical) end portion 164 of flarehead 115, for example, to ignite gas flows of relatively high volume and/or velocity. In another embodiment, the sparking device may be disposed at a position further upstream such as along intermediate (e.g., cylindrical) portion 160, for instance, to ignite gas flows of relatively low volume and/or velocity, as will be appreciated by those skilled in the art.

In one example, landfill gas flowing in a flarehead from a landfill gas vent may advantageously be ignited and continuously burned by generating a continuous series of sparks in the flarehead. Thus, special challenge(s) of burning landfill gas may be addressed. In particular, a wide variety of operating conditions may exist under which it may be desired to burn landfill gas. In a landfill, there may be times when landfill gas is emitted, and times when landfill gas is not emitted. The landfill gas may be emitted, for instance, in intermittent spurts. At various times, the landfill gas may be emitted under weak pressure. Furthermore, the landfill gas may sometimes be emitted with low concentrations of flammable constituents, and at other times with high concentrations of flammable constituents. Moreover, the landfill gas may be emitted under windy or rainy conditions.

While part(s) of the description herein, for explanatory purposes, may imply or indicate certain exemplary direction (s), such direction(s) may be considered relative. Design choice(s) allow accommodation(s) of any orientation(s) for any sparking device(s) and/or flarehead(s) in accordance with the principles of the present invention.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A sparking device, comprising:

a first electrode adapted to be coupled with a first electric potential, said first electrode including an elongate member having proximal and distal parts;

a second electrode adapted to be coupled with a second electric potential, said second electrode including a body, said body receiving said proximal part;

insulation material including first and second insulation portions, said first insulation portion disposed between said proximal part and said body to electrically insulate said proximal part from said body;

said first electrode including an end member connected with said distal part, said end member including a first section with a plurality of first electrical contacts offset from a longitudinal axis of said device, said body including a second section with a plurality of second electrical contacts offset from said longitudinal axis, a plurality of sets of said first and second electrical contacts providing a plurality of gaps for sparking between said first and second electrodes, wherein a difference provided between said first and second electric potentials serves to cause sparking across at least one of said gaps; and said second insulation portion disposed between said longitudinal axis and at least one of said gaps to form a drainage path section, wherein said drainage path section serves to promote avoidance of short-circuiting between said body and at least one of said distal part and said end member during exposure of said device to precipitation.

2. The device of claim 1, wherein first and second contacts of said first electrical contacts are offset from said longitudinal axis by a distance, wherein third and fourth contacts of said second electrical contacts are offset from said longitudinal axis by said distance, wherein said first and third contacts comprise a first set of said plurality of sets, and wherein said second and fourth contacts comprise a second set of said plurality of sets.

3. The device of claim 1, wherein a portion of said end member is formed to draw a precipitation portion away from said body.

4. The device of claim 1, wherein said end member includes at least one of a recessed surface facing said body and a protruding surface facing away from said body.

5. The device of claim 4, wherein said end member includes said recessed surface and wherein said second insulation portion abuts said recessed surface.

6. The device of claim 4, wherein said end member includes said recessed surface and wherein said recessed surface covers an end of said second insulation portion.

7. The device of claim 1, wherein said first electrical contacts comprise a peripheral section of said end member.

8. The device of claim 1, wherein a portion of said body is formed to draw a precipitation portion away from said end member.

9. The device of claim 1, wherein said body includes a recessed surface facing said end member.

10. The device of claim 1, wherein said body includes an inlet open toward said end member.

11. The device of claim 1, wherein said second electrical contacts comprise a peripheral section of said body.

12. The device of claim 1, wherein said elongate member and said end member are formed integrally.

13. The device of claim 1, wherein said first and second insulation portions are formed integrally.

14. The device of claim 1, wherein said body includes a passage therethrough, and wherein said passage receives at least one of said proximal part and said first insulation portion.

15. The device of claim 14, wherein an exposed connection to said proximal part is located without said passage, and wherein a portion of said body is formed to draw a precipitation portion away from said exposed connection.

16. The device of claim 15, wherein a portion of said proximal part is located without said passage.

17. The device of claim 16, wherein a part of said first insulation portion is located without said passage.

18. The device of claim 1 in combination with a flarehead, wherein said plurality of sets are disposed within an open-faced interior of said flarehead.

19. A sparking device, comprising:

a first electrode adapted to be coupled with a first electric potential, said first electrode including an elongate member having proximal and distal parts;

a second electrode adapted to be coupled with a second electric potential, said second electrode including a sleeve having a passage therethrough for receiving said proximal part;

said first electrode including an end member connected with said distal part, said end member including a first section with a plurality of first electrical contacts offset from a longitudinal axis of said device, said sleeve including a second section with a plurality of second electrical contacts offset from said longitudinal axis, a plurality of sets of said first and second electrical contacts providing a plurality of gaps for sparking between said first and second electrodes, wherein a difference provided between said first and second electric potentials serves to cause sparking across at least one of said gaps; and insulation material including first and second insulation portions, said first insulation portion disposed between said proximal part and said sleeve to electrically insulate said proximal part from said sleeve, said second insulation portion disposed between said distal part and at least one of said gaps to form a drainage path section, wherein said drainage path section serves to promote avoidance of short-circuiting between said body and at least one of said distal part and said end member during exposure of said device to precipitation.

20. A method of promoting avoidance of short-circuiting of a sparking device, said method comprising:

selecting first and second electrodes for said device, said first electrode including an elongate member and an end member, said elongate member having proximal and distal parts, said end member connected with said distal part, said second electrode including a body, said body receiving said proximal part;

offsetting a plurality of first electrical contacts of said end member from a longitudinal axis of said device;

offsetting a plurality of second electrical contacts of said body from said longitudinal axis;

employing a plurality of sets of said first and second electrical contacts to form a plurality of gaps for sparking between said first and second electrodes, wherein a difference provided between a first electric potential coupled with said first electrode and a second electric potential coupled with said second electrode serves to cause sparking across at least one of said gaps;

disposing a first insulation portion between said proximal part and said body to electrically insulate said proximal part from said body; and disposing a second insulation portion between said longitudinal axis and at least one of said gaps to form a drainage path section, wherein said drainage path section serves to promote avoidance of short-circuiting between said body and at least one of said distal part and said end member during exposure of said device to precipitation.

* * * * *

UNITED STATES PATENT AND TRADEMARK OFFICE

CERTIFICATE OF CORRECTION

PATENT NO. : 5,984,668

DATED : November 16, 1999

INVENTOR(S) : Hansen et al.

It is certified that error appears in the above-identified patent and that said Letters Patent is hereby corrected as shown below:

Col. 4, line 8, delete "body" and replace with --sleeve--.

Col. 4, line 9, delete "body" and replace with --sleeve--.

Col. 4, line 14, delete "body" and replace with --sleeve--.

Signed and Sealed this

Twenty-second Day of August, 2000

*Attest:*

Q. TODD DICKINSON

*Attesting Officer*

*Director of Patents and Trademarks*